US005961001A

United States Patent [19]

Davis et al.

[11] Patent Number: 5,961,001

[45] Date of Patent: Oct. 5, 1999

[54] VENTING LIQUID DISPENSING SPOUT FOR CLOSED CONTAINER

[75] Inventors: Samuel N. Davis, Dublin; M. Stephen Tschanen, Columbus; Douglas E. Lilly, Westerville, all of Ohio

[73] Assignee: Liqui-Box Corporation, Worthington, Ohio

[21] Appl. No.: 09/050,018

[22] Filed: Mar. 30, 1998

[51] Int. Cl.[6] ..... B67D 5/32

[52] U.S. Cl. ..... 222/153.06; 222/481.5; 222/522

[58] Field of Search ..... 222/185.1, 481.5, 222/153.06, 153.14, 522, 523, 482, 483, 484

[56] References Cited

U.S. PATENT DOCUMENTS 797,471 8/1905 Theuret ..... 222/481.5

3,493,146 2/1970 Conners et al. ..... 222/523

4,478,242 10/1984 Bond ..... 222/522

*Primary Examiner*—Philippe Derakshani

*Attorney, Agent, or Firm*—Vorys Sater Seymour & Pease LLP

[57] ABSTRACT

A spout for dispensing liquid from a closed container has a cap that fits over a fitment or neck on the container, the cap being provided with a sleeve within which a reciprocating barrel may slide from a closed position to an open position. The barrel has a longitudinal vent groove on its upper surface that serves as a passage to admit atmospheric air to equalize internal and external pressure. The cap is provided with a flap that blocks the groove when the internal pressure is close to atmospheric pressure, but opens to admit air when the internal pressure drops significantly below the atmospheric pressure outside the container.

6 Claims, 7 Drawing Sheets

VENTING LIQUID DISPENSING SPOUT FOR CLOSED CONTAINER

BACKGROUND OF THE INVENTION

1. Field of the Invention

This invention relates to spouts for dispensing liquids from closed containers and more particularly to such spouts that are provided with venting means for admitting air to the closed container.

2. Brief Description of the Prior Art

When liquids are dispensed from closed containers the initial flow of liquid out of the container creates a lower pressure, i.e., a partial vacuum, within the container. If the flow is to continue, the partial vacuum must be relieved by admitting atmospheric air. Otherwise, the pressure difference between the interior of the container and the atmosphere outside the container will slow or stop the dispensing of liquid.

For this reason, containers having dispensing spouts at their lower extremity are often provided with vents at their upper ends to equalize the internal and external pressures as the liquids are dispensed. However, providing separate vents for containers introduces an additional complication into the manufacture of the containers. Furthermore, if the liquid is not all dispensed at one time, it may be necessary to open and close the vent together with the dispensing spout.

Accordingly, a number of dispensing spouts have been designed that incorporate vents to admit atmospheric air to the container when the spout is opened to dispense the liquid.

U.S. Pat. No. 2,790,582, to Halpern, discloses a spout for dispensing liquid from a necked container such as a glass bottle for bottled drinks, salad oil and the like. The spout comprises a cylindrical plug sliding within a sleeve that is fixed in the neck of the bottle. The plug has a sealing shoulder, which closes the vessel when the plug is in its closed position. The spout is provided with an internal passage extending from the interior end of the plug to an aperture on the side thereof that is exposed when the plug is partially withdrawn from the sleeve. An axially extending portion of the cylindrical side of the plug is flattened to provide a breather duct between the plug and the sleeve to admit air when the plug is in the open position. In normal careful pouring, the breather duct is not submerged.

U.S. Pat. No. 3,223,296, to Waddington, discloses a dispensing spout for use at the lower end of large storage containers wherein the spout apparatus is entirely submerged. The spout comprises an external barrel within which an internal barrel can slide and rotate. The barrels are provided with apertures that are in register when the internal barrel is partially withdrawn and rotated. The internal barrel is provided with two internal axial passages, one for liquid and one for air, extending from exterior openings to interior apertures that can be placed in register with apertures in the outer barrel inside the container. One passage allows for flow of liquid from the container to the exterior of the vessel, while the other admits atmospheric air to the interior of the container to equalize the pressure.

Although the prior art devices are effective for their designed applications, they involve certain complications in order to prevent leakage of liquid through the air vents, especially when the spout is first opened.

Accordingly, a need has continued to exist for a liquid dispensing spout of simple structure that provides an air vent that minimizes liquid leakage therethrough and is simple to manufacture and operate.

SUMMARY OF THE INVENTION

This goal has now been achieved by the dispensing spout of the invention having a cap that fits over a fitment or neck on the container, the cap being provided with a sleeve within which a reciprocating barrel may slide from a closed position to an open position. The barrel has a longitudinal vent groove on its upper surface that serves as a passage to admit atmospheric air to equalize internal and external pressure. The cap is provided with a flap that blocks the groove when the internal pressure is close to atmospheric pressure, but opens to admit air when the internal pressure drops significantly below the atmospheric pressure outside the container.

Accordingly, it is an object of the invention to provide a liquid dispensing spout.

A further object is to provide a liquid-dispensing spout having a vent to admit atmospheric air.

A further object is to provide a pressure-equalizing liquid-dispensing spout.

A further object is to provide a venting liquid dispensing spout that is easy to manufacture.

Further objects of the invention will become apparent from the description of the invention which follows.

DETAILED DESCRIPTION OF THE INVENTION AND PREFERRED EMBODIMENTS

The vented dispensing spout of the invention provides a device that can dispense liquid from a submerged neck or fitment of a container while admitting a stream of atmospheric air into the container. The device in intended for use with containers, such as those for bottled water and the like, that are made of blow-molded plastic or similar materials. Such containers are typically filled through a relatively wide neck. The neck is then covered and sealed with a cap. It is commercially preferable that the liquid be easily dispensed from the container, for example through a dispensing spout. Accordingly, the container is designed to be stored with the neck at the lower end of the container, and a dispensing spout is typically incorporated into the cap or closure. However, such an arrangement requires a means of venting the container to assure even and continuous flow of liquid. If atmospheric air can enter the container only through the dispensing orifice itself, the flow will typically be uneven and the stream will "gurgle".

If a vent is provided that opens when the dispensing spout is opened, the liquid will typically initially flow out through both the dispensing orifice and the vent. The vent will begin to function only after the pressure within the container drops significantly below the pressure of the external atmosphere.

The venting spout of the invention is provided with a vent that is occluded by a movable flap until the pressure within the container has dropped sufficiently to draw atmospheric air into the container. The occluding vent flap minimizes leakage through the vent when the spout is first opened, but then opens to provide adequate venting of the container.

The invention will be described by reference to the drawings, which show a preferred embodiment of the invention.

Figure 1:
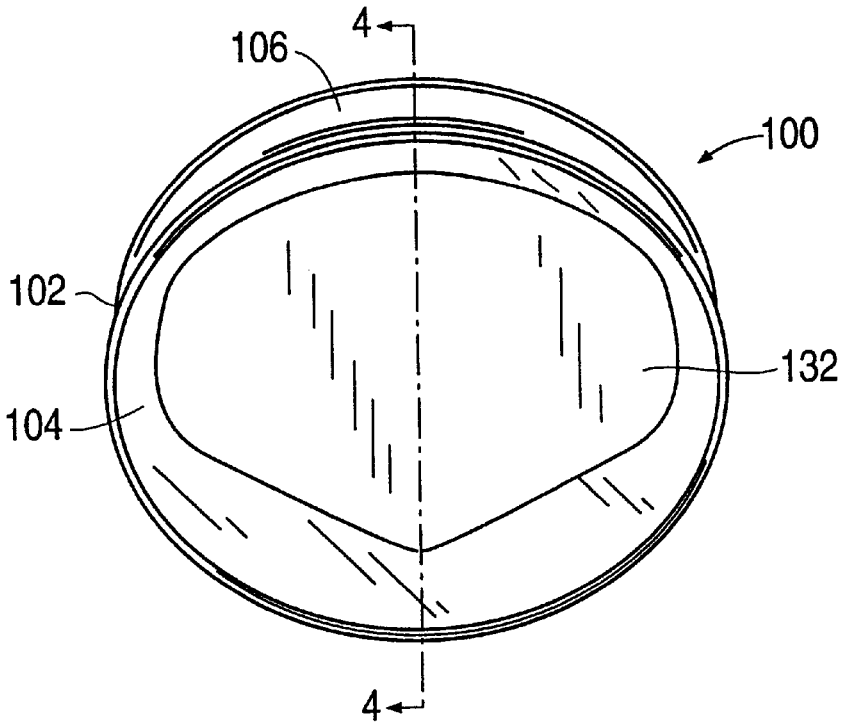
FIG. 1 illustrates a front elevational view of the dispensing spout of the invention.
Figure 2:
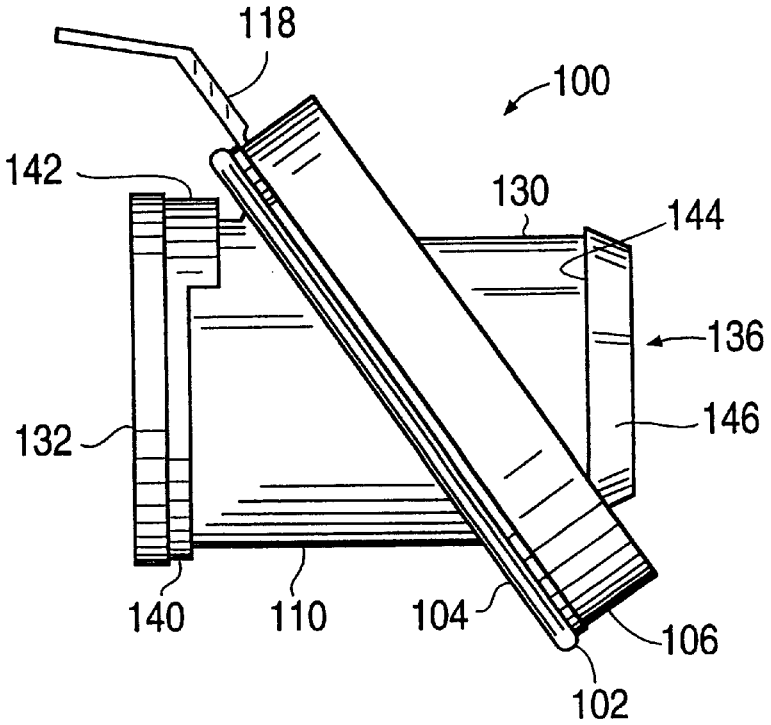
FIG. 2 is a side elevational view of the dispensing spout of the invention.
Figure 3:
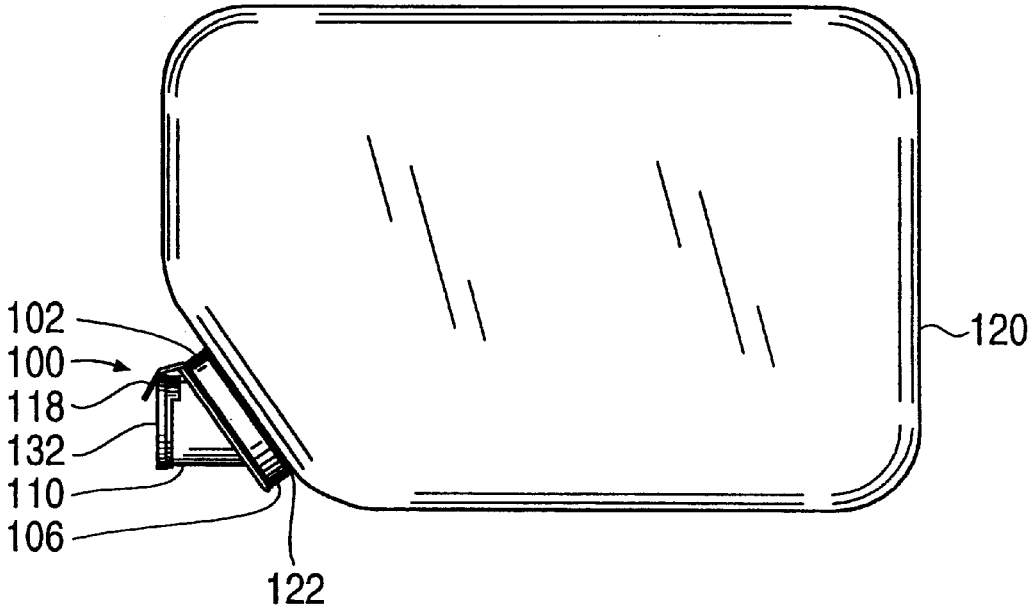
FIG. 3 is a side elevational view showing the spout of the invention in place on a container.

The general appearance of the dispensing spout of the invention and its mounting on a liquid container are shown in FIGS. 1–3. FIGS. 4–10 illustrate the internal structure of the spout and its operation. FIGS. 11–14 show details of the sliding barrel member of the spout.

The dispensing spout 100 comprises a cap 102 having a front wall 104 and an outer skirt 106 and an inner skirt 108 extending from the wall 104. The skirts 106 and 108 are intended to engage a neck or fitment 122 on the container 120 to fasten the cap securely thereto, as shown in FIG. 3. The dispensing spout 100 may be mounted on the neck 122 of the container 120 by any conventional means. Thus the spout and neck may be threaded, or the spout may be adhesively fastened to the neck. It is preferred to provide projections on the neck and the interior of the skirts 106 and 108 of the cap 102 that fit together with an interference or snap fit to hold the cap firmly onto the container with a liquid-tight seal.

A sleeve 110 extends from the wall of the cap 102. In the illustrated embodiment the sleeve extends at an angle to permit the sleeve to extend generally horizontally when the spout 100 is mounted on a typical liquid container 120 as illustrated in FIG. 3. However, it will be recognized that the sleeve 110 could extend generally perpendicularly to the wall 104 in a spout designed to be mounted on a different style container. It is preferable that the sleeve 110 be oriented generally horizontally when the spout is in use for dispensing the contents of the container.

Figure 4:
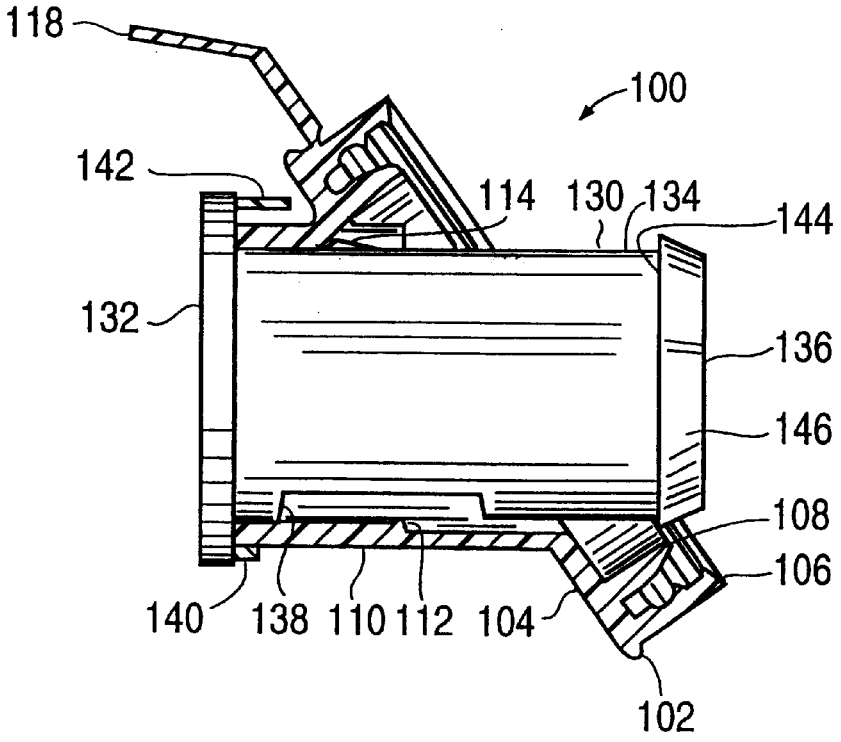
FIG. 4 shows side view of the dispensing spout of the invention with the cap member cut away along the line 4—4 in FIG. 1.
Figure 5:
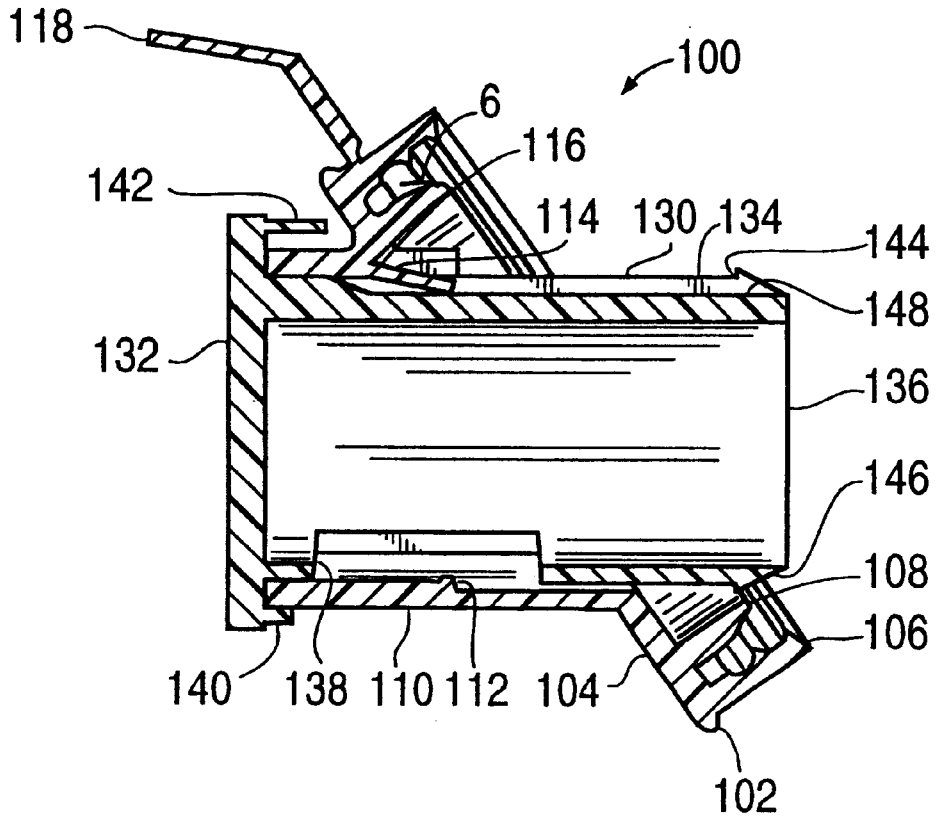
FIG. 5 shows cross-section of the dispensing spout along line 4—4 in FIG. 1.
Figure 6:
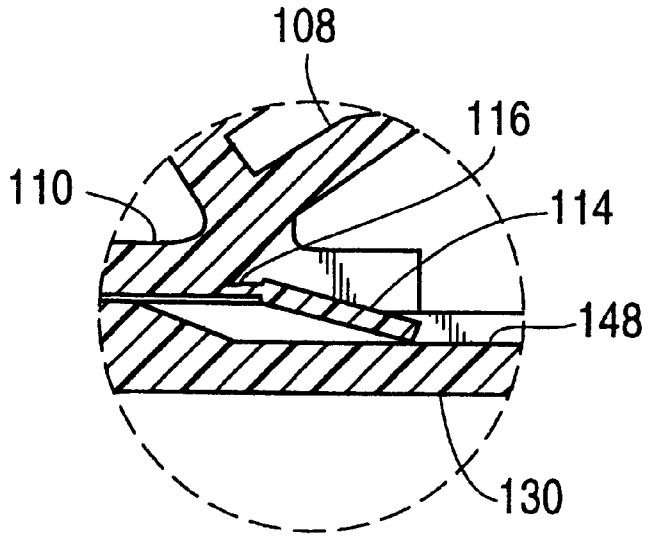
FIG. 6 shows a detail of the vent flap shown in the dashed circle 6 of FIG. 4.

A sliding barrel member 130 is held within the sleeve 110 and reciprocates therein between a closed position and an open position. FIG. 4 shows the barrel 130 within the cap 102 in a partial cut away view. FIG. 5 shows a cross-section of the barrel 130 and cap 102 in the closed position. The barrel 130 has a front or wall 132 and a generally cylindrical side wall 134 extending from the front wall 132 and fitting closely within the sleeve 110. The inner end 136 of the barrel 130 is open to admit liquid to the hollow interior of the barrel 130. A dispensing aperture 138 is located in the side wall 134 near the front wall 132 and on the lower side of the side wall 134. In the closed position a sealing ring 140 fits snugly over the outer end of the sleeve 110 to seal the liquid within the container. After the container is filled sealing tab 118 is bent down and welded by any conventional means, preferably by ultrasonic welding, to the top of the front wall 132 of the barrel 130 in order to provide a tamper-indicating seal as shown in FIG. 3. In the closed position, a vent flap 114 fastened to the cap 102 with a hinge 116 lies within the vent groove 148 formed on outside of the upper surface of the side wall 134. A detail view of the vent flap 114 and hinge 116 is shown in FIG. 6. The hinge 116 and vent flap 114 are typically molded integrally with the cap from essentially the same synthetic resin material as in the other components of the spout, especially linear low density poly (ethylene).

Figure 7:
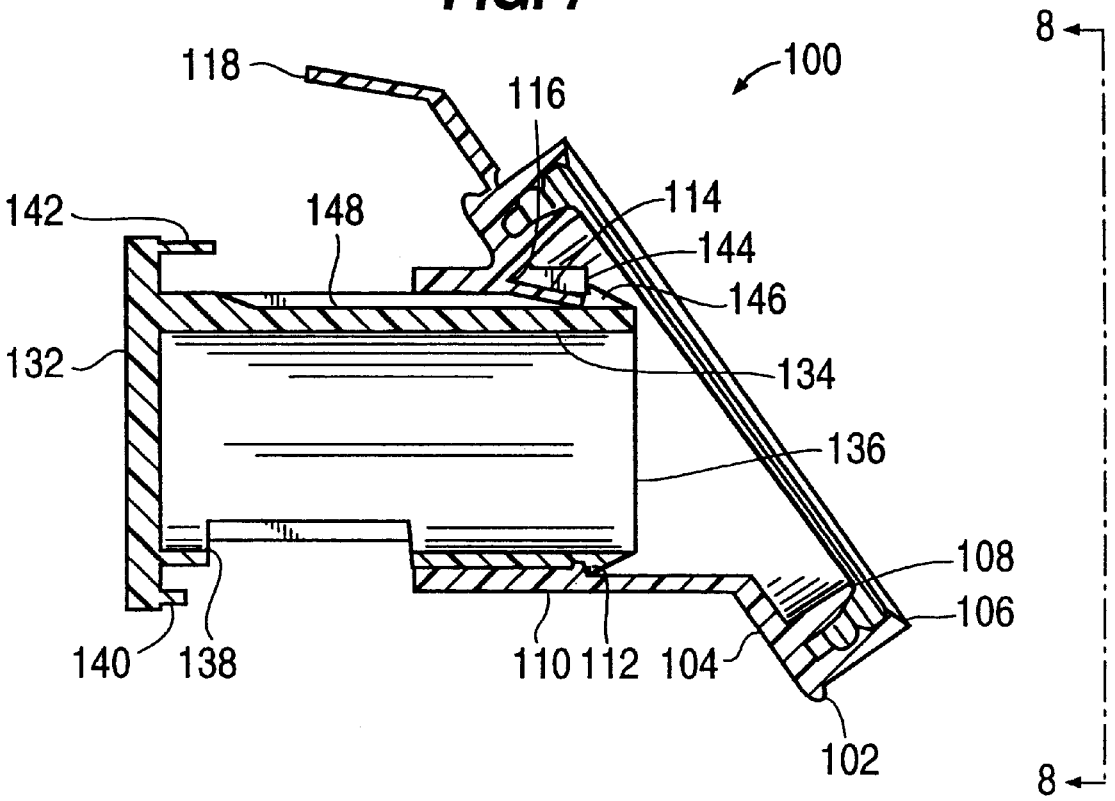
FIG. 7 shows a cross-section, along line 4—4 in FIG. 1, of the dispensing spout in open position with the vent-occluding flap in its vent-occluding position.
Figure 9:
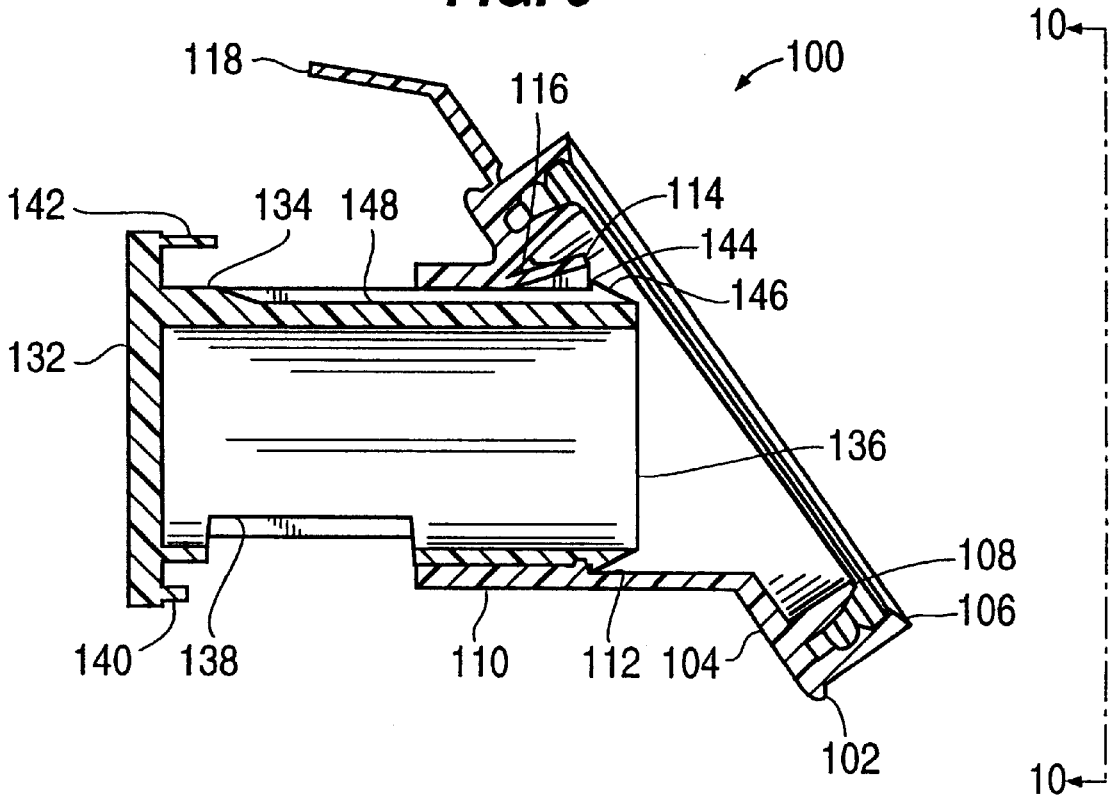
FIG. 9 shows a cross-section of the dispensing spout in open position, along line 4—4 in FIG. 1, with the vent-occluding flap in its open position.

When the liquid is to be dispensed from the container 120, the weld holding the sealing tab 118 to the front wall 132 of the sliding barrel member 130 is broken and the barrel 130 is pulled out of the cap to the open position, illustrated in cross section in FIGS. 7 and 9. The shoulder 144 on the side wall 134 of the barrel 130 contacts the inner end 112 of the sleeve 110 which serves as a stop to limit the travel of the barrel 130.

Figure 8:
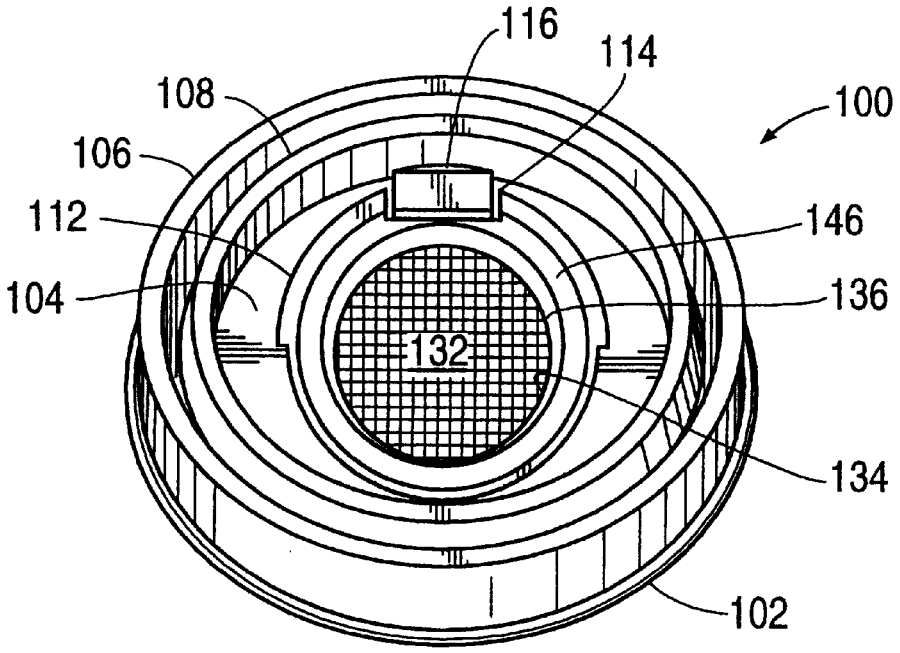
FIG. 8 shows a rear view of the spout, taken in the direction indicated by line 8—8 in FIG. 7, showing the vent flap in closed position.

FIG. 7 shows the vent flap 114 in its initial position when the sliding barrel 130 is pulled to the open position. Its natural tendency to lie in the vent groove 148 is supplemented by the internal pressure of the liquid column inside the container and by the force of the liquid flowing past it. The liquid can flow out of the container through the open interior end 136 of the barrel and the dispensing aperture 138. However, any flow of liquid through the vent groove 148 is prevented or minimized by the lowered vent flap 114. In practice, some liquid may be able to bypass the vent flap 114 and pass down the vent groove 148 to the exterior. However, the amount of liquid that escapes by this path is relatively slight and is much smaller than would occur without the vent flap 114. Any liquid that does flow out through the vent groove 148 is intercepted by the splash shield 142 and directed downward to join the flow exiting from the dispensing aperture 138. FIG. 8 shows a view of the open dispensing spout shortly after opening, with the vent flap 114 in its lowered position, from the direction indicated by the line 8—8 in FIG. 7.

Figure 10:
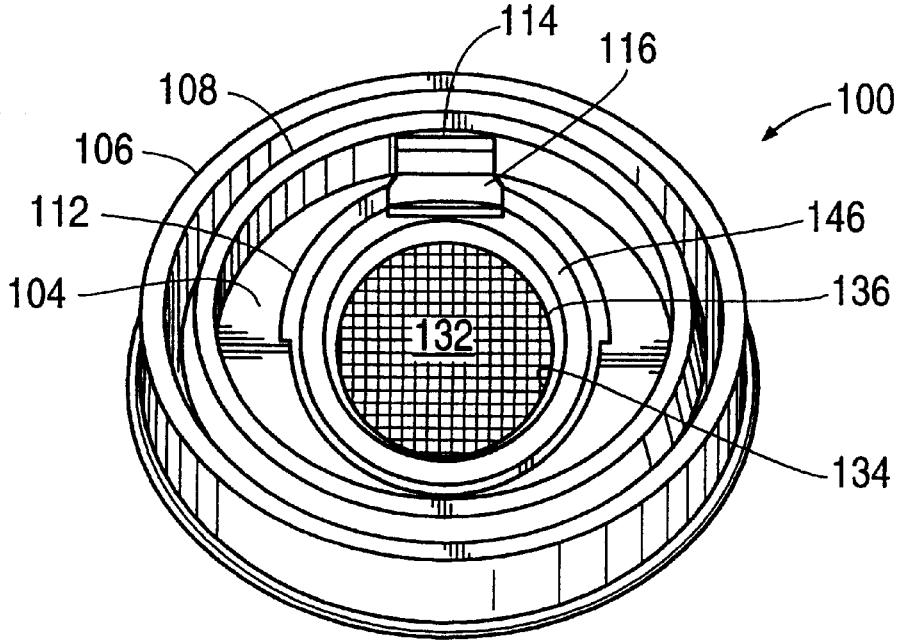
FIG. 10 shows a rear view of the spout, taken in the direction indicated by line 10—10 in FIG. 9, showing the vent flap in open position.
Figure 11:
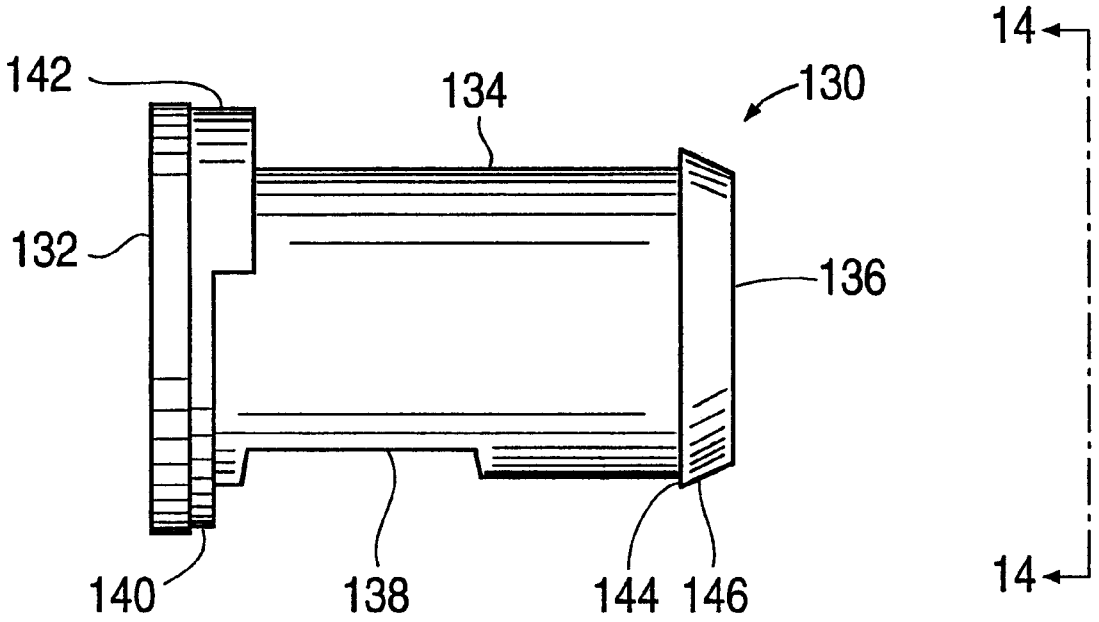
FIG. 11 shows a side elevational view of the barrel of the dispensing spout.
Figure 12:
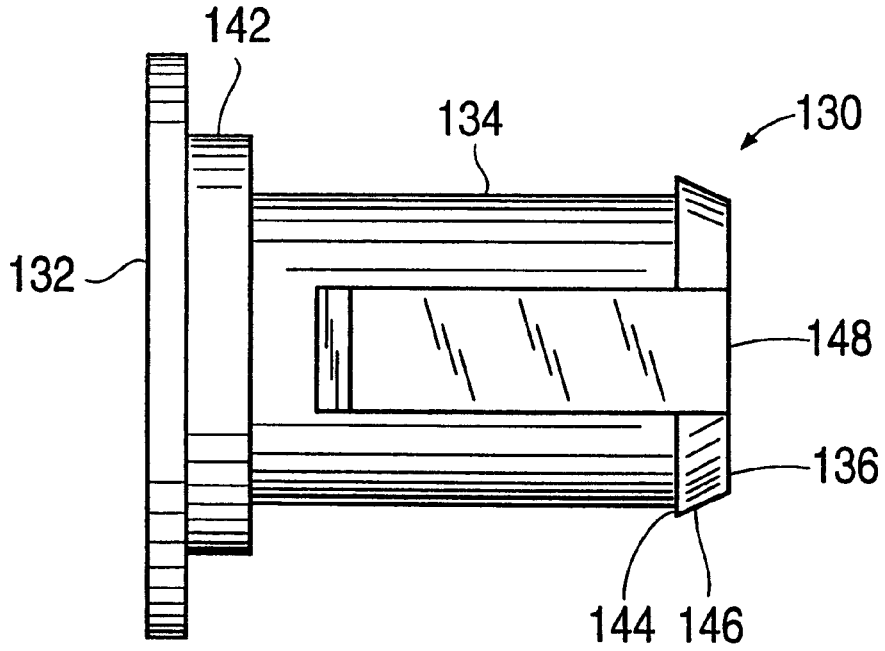
FIG. 12 shows a top plan view of the barrel of the spout.
Figure 13:
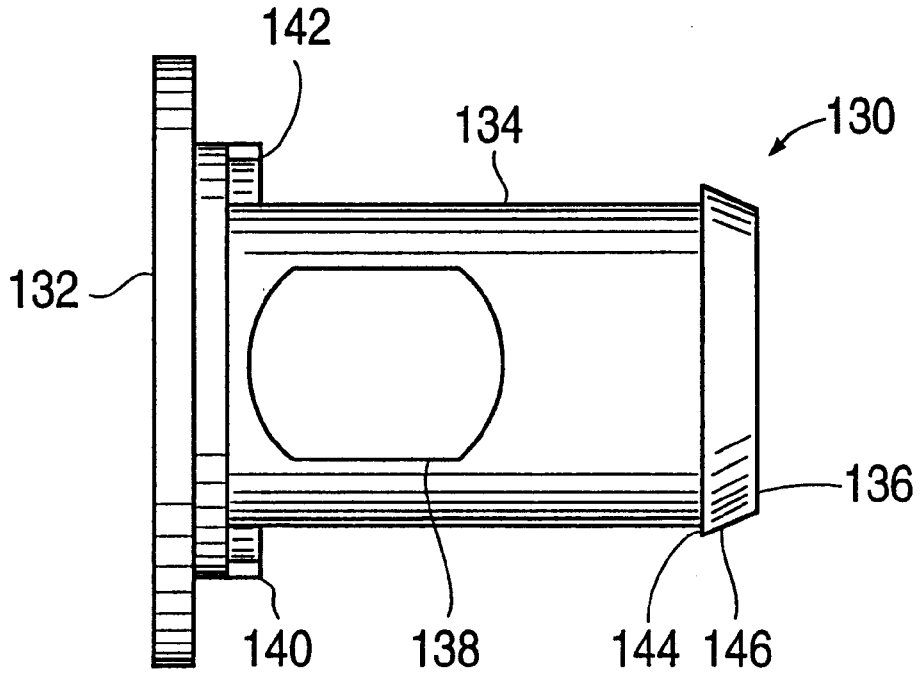
FIG. 13 shows a bottom view of the barrel of the spout.
Figure 14:
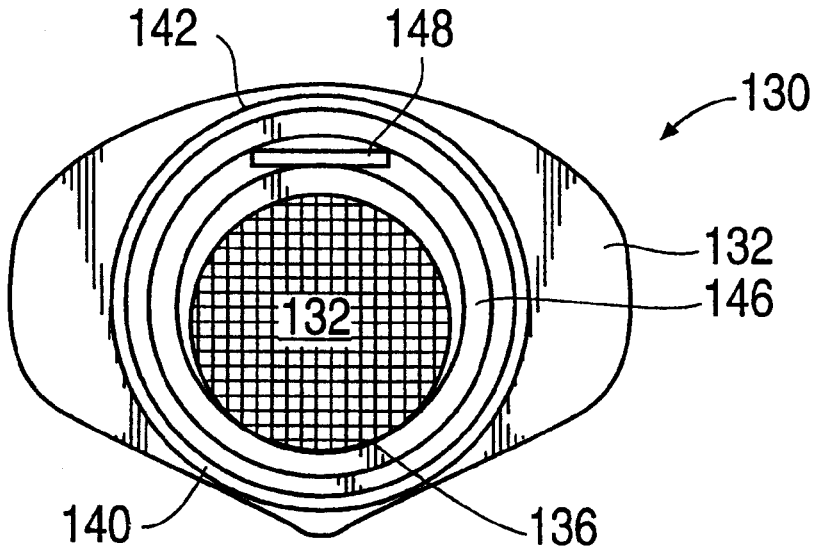
FIG. 14 shows a rear view of the barrel of the spout as indicated by the line 14—14 in FIG. 11.

After some liquid has flowed out of the container 120, the pressure inside the container becomes less than the atmospheric pressure outside. Thereupon, the external pressure forces the vent flap 114 into its raised position as shown in FIGS. 9 and 10. The vent groove 148 is thereby opened to the flow of air into the container, which assures a smooth and steady dispensing of liquid. FIG. 9 is a cross-section of the spout 100 in the open position with the vent flap 114 in its raised position to provide venting. FIG. 10 shows a view of the open dispensing spout after the venting function has commenced, with the vent flap 114 in its raised position, from the direction indicated by the line 10—10 in FIG. 9.

The vent groove 148 in the illustrated embodiment is shown as having a flat bottom, i.e., its cross section transverse to the longitudinal dimension of the barrel exhibits a straight line. However, it is to be understood that the vent groove 148 can be of curved cross section to match the curvature of the transverse cross-section of the barrel. In such a case, the vent flap 114 will also be curved to match the general curvature of the bottom of vent groove 148.

FIGS. 11–14 show the details of the sliding barrel member 130 of the dispensing spout 100. The barrel 130 is provided with a tapered end region 146 to permit assembly of the barrel 130 and cap 102 simply by forcing the barrel 130 into the exterior end of the sleeve 110. Once the barrel has been inserted, the shoulder 144 and inner end 112 of sleeve 110 prevent the barrel 130 from coming out of the sleeve 110 when the spout 100 is opened to dispense liquid.

In the illustrated embodiment the sliding barrel of the spout is of generally circular cross-section so that the barrel has the general shape of a circular cylinder. However, it will be understood that the cross section of the sleeve and barrel can be any matching cross sectional shape. Thus the barrel may be generally cylindrical of other than circular cross section or even prismatic in shape.

The dispensing spout can be made of any suitable material that provides the necessary structural rigidity and corrosion resistance appropriate to the liquid being dispensed. It is preferred to make the spout from a synthetic resin material. It is convenient to mold the spout components from a thermoplastic material, particularly a material that permits the integral molding of the hinge and vent flap of the cap. Possible materials include poly(ethylene), poly(propylene), poly(ethylene terephthalate), polycarbonate, and the like. A preferred material of construction is linear low density poly(ethylene) (LLDPE). Conventional molding techniques appropriate for such materials can be used to manufacture the dispensing spout of the invention.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

We claim:

1. A vented liquid dispensing spout comprising a cap having a front wall, mounting means integral with said wall for mounting said cap to a neck of a liquid container, and a sleeve projecting from said front wall; and a barrel slidably mounted in said sleeve and movable between a closed position and an open position, said barrel having an outer end and an inner end and a side wall having a generally cylindrical exterior surface and extending between said outer end and said inner end, an end wall occluding said outer end of said side barrel, said inner end of said barrel being open, and said side wall having a dispensing aperture extending therethrough, said sidewall having a longitudinal vent groove on its exterior surface, said cap being provided with means for selectively opening and occluding said vent groove.

2. Tie dispensing spout of claim 1 wherein said means for selectively opening and occluding said vent groove comprises a flap mounted on said cap with a hinge.

3. The dispensing spout of claim 2 wherein said flap extends from said hinge generally toward said internal end of said barrel.

4. The dispensing spout of claim 3 wherein said flap is held in its occluding position by pressure within said container.

5. The dispensing spout of claim 1 wherein said spout is made of linear low density poly(ethylene).

6. The dispensing spout of claim 1 wherein said vent groove is curved in cross-section and said vent flap matches said curved cross-section of said groove.

* * * * *